US011554928B2

(12) United States Patent
Yamada

(10) Patent No.: US 11,554,928 B2
(45) Date of Patent: Jan. 17, 2023

(54) SHEET FEEDING APPARATUS, IMAGE READING APPARATUS, AND IMAGE FORMING APPARATUS

(71) Applicant: CANON KABUSHIKI KAISHA, Tokyo (JP)

(72) Inventor: Kaname Yamada, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 100 days.

(21) Appl. No.: 17/069,372

(22) Filed: Oct. 13, 2020

(65) Prior Publication Data

US 2021/0122596 A1 Apr. 29, 2021

(30) Foreign Application Priority Data

Oct. 23, 2019 (JP) ..... JP2019-192432

(51) Int. Cl.
*B65H 7/04* (2006.01)
*B65H 5/06* (2006.01)
*B65H 9/04* (2006.01)

(52) U.S. Cl.
CPC ..... *B65H 7/04* (2013.01); *B65H 5/06* (2013.01); *B65H 9/04* (2013.01); *B65H 2404/15* (2013.01); *B65H 2511/515* (2013.01); *B65H 2801/06* (2013.01)

(58) Field of Classification Search
CPC ... B65H 7/04; B65H 5/06; B65H 9/04; B65H 2404/15; B65H 2511/515; B65H 2801/06; B65H 3/06; B65H 3/0661; B65H 3/0607; B65H 3/0669
See application file for complete search history.

(56) References Cited

U.S. PATENT DOCUMENTS 5,209,465 A * 5/1993 Sayama ..... B65H 3/0669 271/118
6,292,636 B1 * 9/2001 Kwon ..... G03G 15/6502 271/265.01
7,597,313 B2 * 10/2009 Dan ..... B41J 13/103 271/110
8,313,097 B2 * 11/2012 Kayama ..... B65H 3/34 271/117

(Continued)

FOREIGN PATENT DOCUMENTS

JP 2001-031284 A 2/2001

*Primary Examiner* — Thomas A Morrison
(74) *Attorney, Agent, or Firm* — Canon U.S.A., Inc. I.P. Division

(57) ABSTRACT

A sheet feeding apparatus includes a tray on which a sheet is to be placed, a feeding roller, a separating portion that forms a separation nip to separate sheets, a rotating member provided between the feeding position and the separation nip in a sheet conveying direction, a first detecting sensor, a second detecting sensor, a driving source, and a control portion. The rotating member rotates by being pushed by a leading end of the sheet. The control portion detects a position of a trailing end of a preceding sheet separated by the separating portion by using the second detecting sensor, and detects presence or absence of a subsequent sheet placed on the tray by using the first detecting sensor. Based on detection results of the first detecting sensor and second detecting sensor, the control portion controls the driving source such that the feeding roller starts to feed the subsequent sheet.

12 Claims, 11 Drawing Sheets

(56) References Cited

U.S. PATENT DOCUMENTS

| | | | | |
|---|---|---|---|---|
| 9,302,863 | B1 * | 4/2016 | Piening | B65H 3/0684 |
| 2004/0061283 | A1 * | 4/2004 | Hyun | B65H 7/02<br>271/265.01 |
| 2009/0067855 | A1 * | 3/2009 | Shim | G03G 15/6561<br>399/21 |
| 2015/0151935 | A1 * | 6/2015 | Murakami | B65H 1/18<br>271/3.19 |

* cited by examiner

SHEET FEEDING APPARATUS, IMAGE READING APPARATUS, AND IMAGE FORMING APPARATUS

BACKGROUND

Field

The present disclosure relates to a sheet feeding apparatus for feeding a sheet, an image reading apparatus such as a scanner including the sheet feeding apparatus, and an image forming apparatus such as a copying machine, a printer, or a facsimile apparatus including the sheet feeding apparatus.

Description of the Related Art

Conventionally, a sheet is conveyed based on a detection signal of a detection portion for detecting the sheet in an image forming apparatus such as a copying machine. For example, as an operation of conveying sheets, the present or absence of the sheets set on a tray is detected and the sheets are fed by the feeding roller. Thereafter, the fed sheets are separated one by one by a separating portion and conveyed to an image forming portion by the conveying roller pair.

Japanese Patent Application Laid Open Publication No. 2001-031284 discloses the configuration in which a sensor is provided downstream of the separating portion in the sheet conveying direction, and in which after the rear end of a preceding sheet is detected by the sensor, the feeding of a subsequent sheet placed in the tray is started.

However, in of Japanese Patent Application Laid Open Publication No. 2001-031284, when a subsequent sheet fed, the distance between a position where the trailing end of the preceding sheet is detected and a position of the leading end of the subsequent sheet set in the tray is large. As such, the distance between the sheets is large, which may reduce the productivity of the sheet feeding apparatus.

SUMMARY

According to an aspect of the present disclosure, a sheet feeding apparatus includes a tray on which a sheet is to be placed, a feeding roller configured to feed the sheet at a feeding position at which the feeding roller abuts against the sheet placed on the tray, a separating portion configured to form a separation nip configured to separate, one by one, sheets fed by the feeding roller, a rotating member provided between the feeding position and the separation nip in a sheet conveying direction, wherein the rotating member is configured to be rotated by being pushed by a leading end of the sheet placed on the tray, a first detecting sensor configured to detect presence or absence of a sheet on the tray by detecting rotation of the rotating member, a second detecting sensor configured to detect a position of a trailing end of the sheet by detecting rotation of the rotating member in a case where the sheet passes between the feeding position and the separation nip in the sheet conveying direction, a driving source configured to drive the feeding roller to rotate, and a control portion, wherein the control portion is configured to detect a position of a trailing end of a preceding sheet separated by the separating portion by using the second detecting sensor, and is configured to detect presence or absence of a subsequent sheet placed on the tray by using the first detecting sensor, and wherein, based on detection results of the first detecting sensor and second detecting sensor, the control portion controls the driving source such that the feeding roller starts to feed the subsequent sheet.

With the above configuration, the productivity of the sheet feeding apparatus can be improved.

Further features of the present disclosure will become apparent from the following description of exemplary embodiments with reference to the attached drawings.

DESCRIPTION OF THE EMBODIMENTS

Hereinafter, preferred embodiments of the present disclosure will be illustratively described in detail with reference to the drawings. The dimensions, materials, shapes, and their relative arrangements of the components described in the following embodiments are not intended to limit the scope of the present disclosure only to them unless otherwise specified.

(Overall Image Forming Apparatus)

Figure 1:
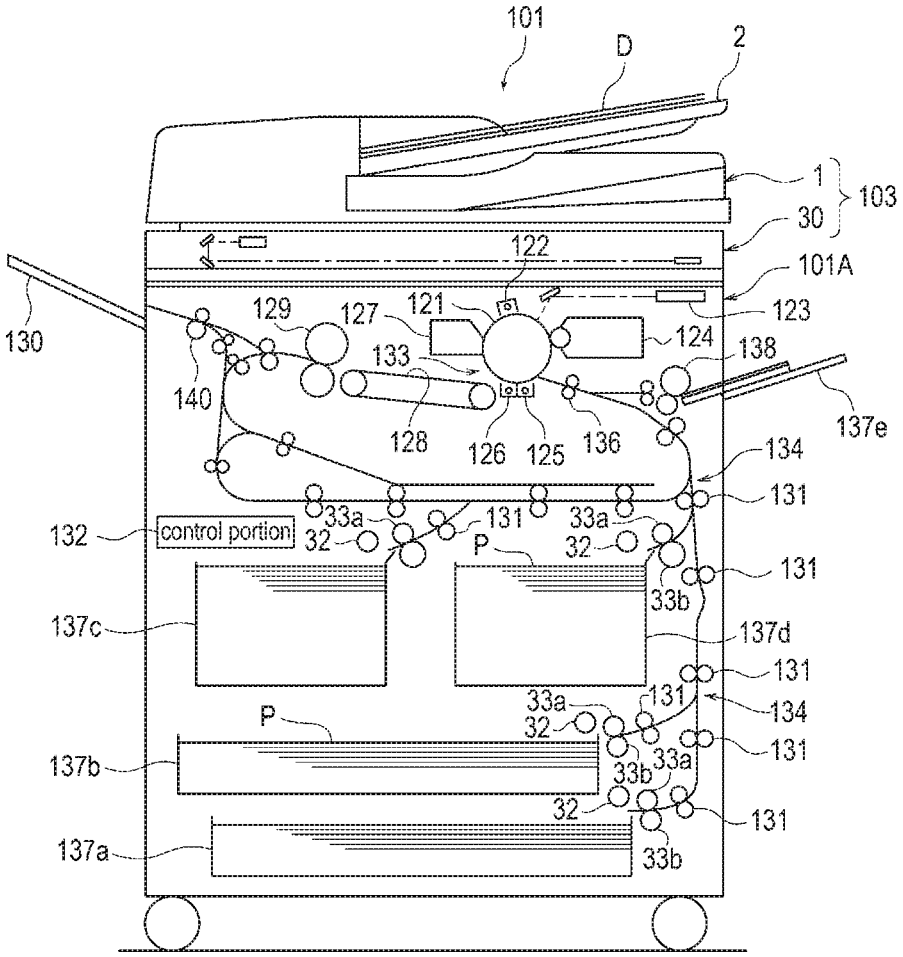
FIG. 1 is a cross-sectional view of an image forming apparatus.

The schematic configuration of the image forming apparatus according to the present embodiment will be described with reference to FIG. 1. FIG. 1 is a sectional view of an image forming apparatus according to this embodiment. The image forming apparatus 101 is, for example, a copying machine, and includes the apparatus main body 101A and the image reading apparatus 103 provided on the upper portion of the apparatus main body 101A.

The image reading apparatus 103 is configured to automatically convey the document D placed on the document feeding tray 2 by a user. The document D is a sheet to be read, and is made from paper such as in a case of a paper sheet or an envelope, plastic film such as in a case of an overhead projector (OHP) sheet, or cloth. The image reading apparatus 103 reads an image of the document D. Specifically, at the image reading position, the image reading apparatus 103 receives the reflected light of the light emitted to the document D that is being conveyed, optically reads the image of the document D, and converts the image into an electrical signal so that the image data (image reading information) is created based on this electrical signal.

The apparatus main body 101A of the image forming apparatus 101 includes the image forming portion 133 that forms an image on the sheet P which is a recording target, and the sheet feeding portion 134 that feeds the sheet P to the image forming portion 133. The sheet feeding portion 134 includes the sheet storing portions 137*a*, 137*b*, 137*c*, and 137*d* capable of respectively storing sheets of different sizes. The sheets stored in the respective sheet storing portions are picked up by the pickup rollers 32 and are separated one by one by the feed rollers 33*a* and the retard rollers 33*b* to be passed on to the conveying roller pairs 131 respectively. Then, the sheet P is sequentially passed on the conveying roller pairs 131 arranged along the sheet conveying path so as to be conveyed to the registration roller pair 136.

The sheet placed on the manual feed tray 137*e* by a user is fed to the inside of the apparatus main body 101A by the feed roller 138 and is conveyed to the registration roller pair 136. The registration roller pair 136 stops the leading end of the sheet P to correct the skew feeding and restarts the conveyance of the sheet P in accordance with the progress of the image forming operation that is a toner image forming process by the image forming portion 133.

The image forming portion 133 forms an image on the sheet P using an electrophotographic method, and includes the photosensitive drum (photosensitive body) 121, the charger 122, the developing device 124, and the like. The photosensitive drum 121 is rotatable along the conveying direction of the sheet P. The charger 122, the exposing device 123, the developing device 124, the transfer charger 125, the separating charger 126, and the cleaner 127 are provided around the photosensitive drum 121. The charger 122 uniformly charges the surface of the photosensitive drum 121. The exposing device 123 exposes the photosensitive drum 121 based on image information input from the image reading apparatus 103 or the like to form an electrostatic latent image on the photosensitive drum 121.

The developing device 124 contains two-component developer having toner and carrier. The developing device 124 supplies the charged toner to the photosensitive drum 121 to develop an electrostatic latent image into a toner image. By the bias electric field formed by the transfer charger 125, the toner image borne on the photosensitive drum 121 is transferred to the sheet P conveyed from the registration roller pair 136. The sheet P on which the toner image is transferred is separated from the photosensitive drum 121 by the bias electric field formed by the separating charger 126, and is conveyed toward the fixing portion 129 by the pre-fixing conveying portion 128. The cleaner 127 removes adhered substances such as transfer residual toner remaining on the photosensitive drum 121 without being transferred to the sheet P, and the photosensitive drum 121 prepares for the next image forming operation.

The sheet P conveyed to the fixing portion 129 is nipped by a pair of rollers and heated while being pressurized, and the image on the sheet P is fixed by melting and fixing of the toner. When the image output is completed, the sheet P on which the fixed image is fixed is discharged to the discharge tray 130 protruding outside the apparatus main body 101A via the discharge roller pair 140.

The image forming apparatus 101 described above is controlled by the control portion 132 having a CPU.

(Image Reading Apparatus)

Figure 2:
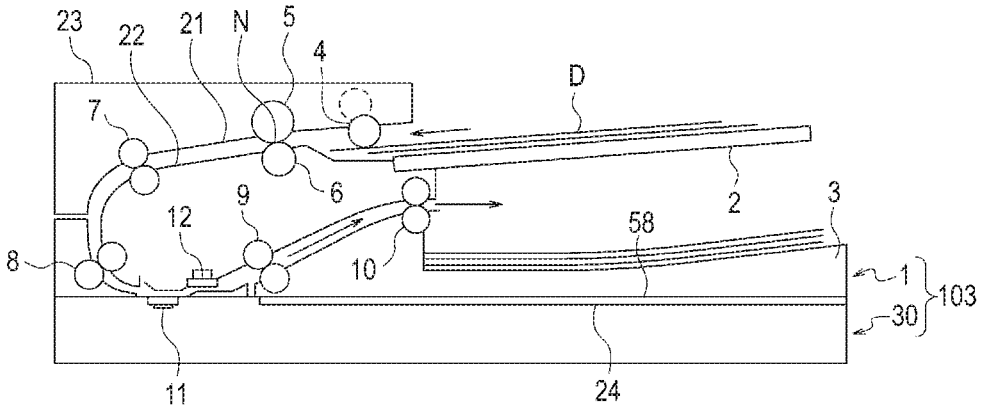
FIG. 2 is a schematic view of an image reading apparatus.

Next, the schematic configuration of the image reading apparatus 103 with a sheet conveying apparatus according to the present embodiment will be described. FIG. 2 is a schematic diagram of the image reading apparatus according to this embodiment. The image reading apparatus 103 includes the reading apparatus main body 30 and the automatic document feeder (hereinafter referred to as ADF) 1 as a sheet feeding apparatus. Further, the image reading apparatus 103 includes the first reading unit 11 as an image reading portion arranged in the reading apparatus main body 30 and the second reading unit 12 as an image reading portion arranged in the ADF 1. Hereinafter, the elements of the image reading apparatus 103 will be described.

The first reading unit 11 is an image reading portion that reads image information from the first surface of the document D. The second reading unit 12 is an image reading portion that reads an image on the second surface of the document D, which surface is opposite to the first surface. The image data read by the first reading unit 11 or the second reading unit 12 is output to the control portion 132 (see FIG. 1). However, the first reading unit 11 and the second reading unit 12 do not always execute simultaneous reading of both sides and it is possible for only either side to be read.

The reading apparatus main body 30 is fixed to the upper surface of the apparatus body 101A (see FIG. 1). As shown in FIG. 2, the flat-bed type document table 24 is arranged on the upper surface of the reading apparatus main body 30. The first reading unit 11 is supported by a carriage (not shown) that can move in the left and right directions in the drawing, and can move from the position shown in FIG. 2 along the document table 24 over the entire length of the document table 24.

The ADF 1 is supported by a hinge mechanism (not shown) arranged on the far side in the drawing to be vertically openable and closable with respect to the reading apparatus main body 30. The pressing plate 58 is formed on the ADF 1 to face the document table 24 of the reading apparatus main body 30. In addition to the second reading unit 12, the ADF 1 includes the document feeding tray 2 as a tray, and the document conveying portion 23. The document feeding tray 2 as a sheet supporting portion supports the document D placed by a user. The document conveying portion 23 has a document conveying path formed by the conveying guides 21 and 22 therein. The document D placed on the document feeding tray 2 is fed by the document conveying portion 23 to the first reading unit 11 and the second reading unit 12 via the document conveying path.

Next, the document conveying portion 23 will be described in detail. The document conveying portion 23 includes the pickup roller 4 which is a feeding roller, the separating portion with the feed roller 5 and the retard roller 6, the registration roller pair 7, the conveying roller pairs 8 and 9, and the discharge roller pair 10 in this order along the document conveying direction which is the sheet conveying direction (indicated by the arrow in FIG. 2). The pickup roller 4 feeds the document D at the feeding position (the position indicated by the solid line in FIG. 2) at which the pickup roller 4 abuts against the document D placed on the document feeding tray 2. The feed roller 5 and the retard roller 6 which serve as the separating portion form the separation nip N for separating one by one the documents D fed by the pickup roller 4.

Further, the document conveying portion 23 has the document stopper 14 which is a restricting member, and the releasing portion 17 that is connected to the document stopper 14. The document stopper 14 is provided between the feeding position and the separation nip N in the document conveying direction. The document stopper 14 abuts against the leading end of the document D when the document D is placed on the document feeding tray 2, and restricts the document D so that the document D does not enter the separation nip N. The releasing portion 17 releases the restriction of the conveyance of the document D to the downstream side in the document conveying direction in conjunction with the lowering of the pickup arm 47 to be described later.

Figure 5:
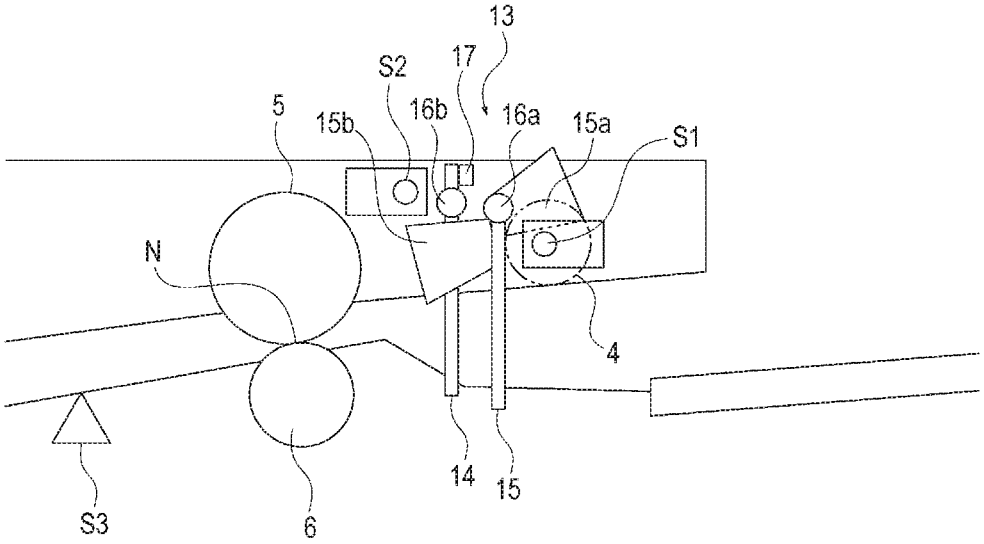
FIG. 5 illustrates a position of a flag when a document is absent.

As shown in FIG. 5, the first detecting portion 13 for detecting the document D is arranged upstream of the separating portion in the document conveying direction. Further, the registration sensor S3 as a second detecting portion for detecting the document D is arranged downstream of the separating portion.

The first detecting portion 13 has the flag 15, the first detecting sensor S1, and the second detecting sensor S2. The flag 15 is a rotating member that rotates about the rotational fulcrum 16*a* when pressed by a document that is a sheet to be read. Each of the first detecting sensor S1 and the second detecting sensor S2 has an optical path through which light is transmitted or shielded when the flag 15 is rotated. In the present embodiment, transmissive photosensors are adopted as the first detection sensor S1 and the second detection sensor S2. The flag 15 has the first light-shielding portion 15*a* for transmitting or shielding the light in the light path of the first detection sensor S1, and the second light-shielding portion 15*b* for transmitting or shielding the light of the light path of the second detection sensor S2 at a different timing than that of the first light-shielding portion 15*a*. The flag 15 is provided between the feeding position (the position of the pickup roller 4 indicated by the solid line in FIG. 2) and the separation nip N in the document conveying direction. The flag 15 is rotated by being pressed by the leading end of the document D placed on the document feeding tray 2. The first detection sensor S1 detects the rotation of the flag 15 to detect the presence or absence of the document D placed on the document feeding tray 2. The second detecting sensor S2 detects the rotation of the flag 15 to detect the position of the trailing end of the document D passing between the feeding position and the separation nip N in the document conveying direction.

When the document D is not placed on the document feeding tray 2, the first and second light-shielding portions 15*a* and 15*b* of the flag 15 are located at a position where the light in the light path of the first and second detection sensors S and S2 is transmitted, respectively. The position of the flag 15 shown in FIG. 5 is referred to as the first position. When the document D is placed on the document feeding tray 2 such that the leading end of the document D abuts against the document stopper 14, which is a restricting member, the flag 15 is pushed by the leading end of the document D and is moved from the first position shown in FIG. 5 to the second position shown in FIG. 6 by being rotated in the conveying direction (clockwise direction) around the rotational fulcrum 16*a*. When the flag 15 is moved to the second position, the first light-shielding portion 15*a* is moved from a position at which the light in the light path of the first detecting sensor S1 is transmitted to a position at which the light in the light path of the first detecting sensor S1 is shielded, so that the first detecting sensor S detects the first light-shielding portion 15*a*. Further, after the restriction of the leading end position of the document D is released by the releasing portion 17, the flag 15 is pushed by the leading end of the document D fed by the pickup roller 4 and is further rotated in the conveying direction (clockwise direction) around the rotational fulcrum 16*a* to move from the second position shown in FIG. 6 to the third position shown in FIG. 7. When the flag 15 is moved to the third position, the second light-shielded portion 15*b* is moved from a position at which the light of the light path of the second detecting sensor S2 is transmitted to a position at which the light of the light path of the second detecting sensor S2 is shielded, so that the second detecting sensor S2 detects the second light-shielding portion 15*b*.

In other words, the first detecting portion 13 can detect one flag at different times by two sensors. In the present embodiment, the flag 15 is configured to be positioned at the first position shown in FIG. 5 by the weight of the parts to reduce the number of parts, but a torsional coil spring or other urging member may also be used. The configuration with a plurality of light-shielded portions is illustrated here, but the present disclosure is not limited to this configuration. As long as the configuration is adopted in which one flag is detected at different times by two sensors, only one light-shielded portion may be used.

The registration sensor S3 as the second detecting portion is a reflective photosensor that performs detection based on the light reflected from the object (for example, a document) when the object is irradiated with light. However, the present disclosure is not limited to this configuration, a detecting portion having a flag and a sensor may also be adopted.

As shown in FIG. 2, the separating portion includes the feed roller 5 that conveys a document and the retard roller 6 that faces the feed roller 5. The retard roller 6 is pressed against the feed roller 5, is input with a rotational driving force in the direction opposite to the conveying direction via a torque limiter, and separates one by one the documents D conveyed by the feed roller 5. A rotational driving force may not be input to the retard roller 6.

The pickup roller 4, which is a feeding roller, is supported by the pickup arm 47 (see FIG. 3) as an elevating and lowering portion so as to be able to be elevated and lowered, and is moved from the retreat position (position indicated by the dashed line in FIG. 2) at which the pickup roller 4 is away from the document D on the document feeding tray 2 to the feeding position (position indicated by the solid line in FIG. 2) at which the pickup roller 4 abuts against the document D to start feeding the document. That is, the pickup arm 47 supports the pickup roller 4 such that the pickup roller 4 can be contacted with, and separated from the document. The feed roller 5 and retarded roller 6 of the separating portion form the separation nip N for separating one by one the documents D fed by the pickup roller 4, and convey the separated document D downstream in the document conveying direction.

With the rotation of the registration roller pair 7 stopped, the registration roller pair 7 receives the downstream end (hereinafter referred to as the leading end) of the document D conveyed by the feed roller 5 in the conveying direction and the document D bends, so that the skew feeding is corrected. The registration roller pair 7 also conveys the document D whose skew feeding has corrected through the bent portion of the document conveying path. While the document D, which has been conveyed by the registration roller pair 7, is being conveyed by the conveying rollers pair 8 and 9, the image on the document D is read by the first reading unit 11 and the second reading unit 12. Then, the document D whose image has been read is discharged to the document discharge tray 3 by the discharge roller pair 10.

The image reading apparatus 103 so configured reads image information from the document D in a moving document reading mode in which the document image is scanned while feeding the document D by ADF 1 and a fixed-document reading mode in which the document placed on the document table 24 is scanned. The moving document reading mode is selected when the first detecting portion 13 detects the document D placed on the document feeding tray 2, or when a user explicitly designates this mode with the operation portion 61 (see FIG. 4) of the apparatus main body 101A. In this case, with the first reading unit 11 in the position shown in FIG. 2, the ADF 1 feeds the documents D toward the first reading unit 11 one by one. Both the first reading unit 11 and the second reading unit 12 read the images of the document D in the case of simultaneous double-sided reading, and one of the reading units 11 and 12 reads the image of the document D in the case of single-sided reading.

On the other hand, the fixed-document reading mode is selected when the apparatus detects a document placed on the document table 24 and positioned by the pressing plate 58 or when a user explicitly designates this mode with the operation portion 61 (see FIG. 4) of the apparatus main body 101A. In this case, the first reading unit 11 reads the image of the document placed on the document table 24 while moving along the document table 24. The read image data is transferred to the control portion 132 of the apparatus main body 101A.

(Drive Transmission Mechanism)

Figure 3:
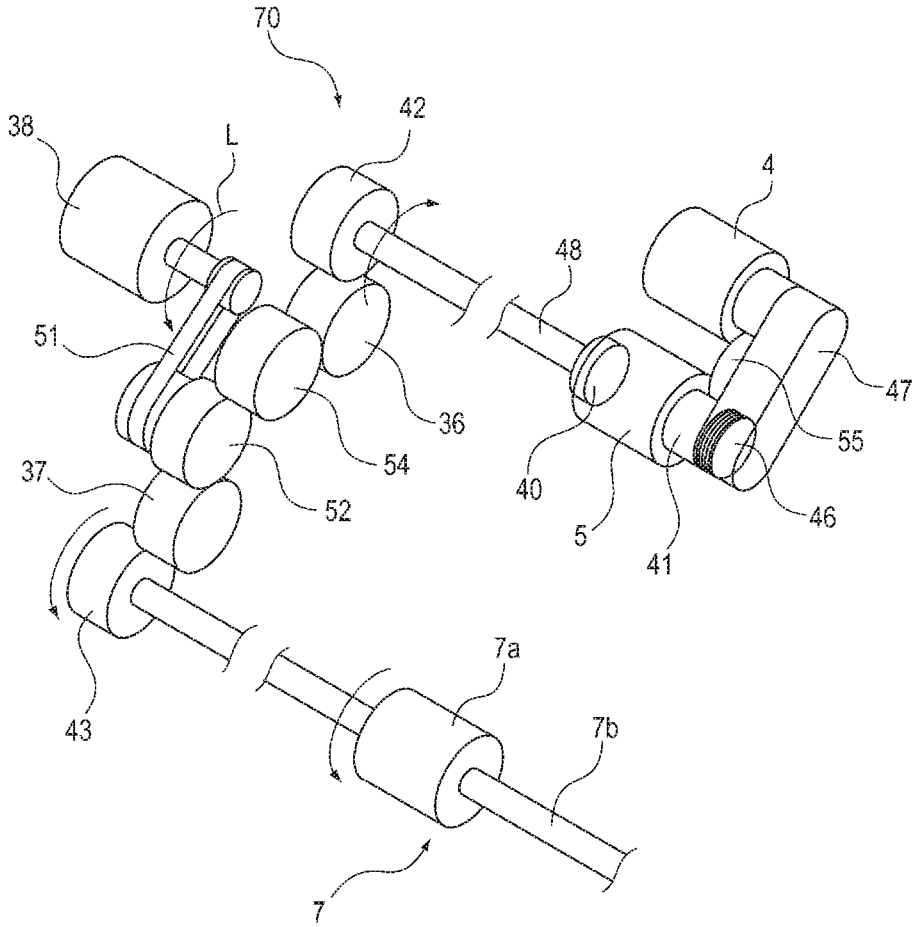
FIG. 3 is a schematic configuration view of a drive transmission mechanism.

Next, the drive transmission mechanism 70 and its peripheral configuration will be described with reference to FIG. 3. The drive transmission mechanism 70 can transmit the driving force of the conveying motor 38 to the pickup roller 4, the feed roller 5, the retard roller 6, and the registration roller pair 7. The rotation by the driving force of the conveying motor 38 as a driving source is transmitted to the input gear 52 via the transmission belt 51. The rotation of the input gear 52 is transmitted to the feed gear 42 fixed at one end of the feed shaft 48 via the intermediate gear 54 and the electromagnetic clutch 36 as the first clutch.

The feed roller 5 is rotatably supported at the other end of the feed shaft 48 via a one-way clutch 40. This end is opposite to the end at which the feed gear 42 is provided. The pickup arm 47 is rotatably supported on the feed shaft 48 via the spring clutch 46. The pickup roller 4 is rotatably supported at the tip of the pickup arm 47. The spring clutch 46 transmits the rotational force of the feed shaft 48 up to a predetermined limit value to the pickup arm 47, thereby to urge the pickup arm 47 downward. Accordingly, when a document is conveyed, the feed shaft 48 is rotated by the conveying motor 38 and the pickup arm 47 is lowered. The contact pressure between the pickup roller 4 and the document is set to be a predetermined pressure depending on the weight of the pickup arm 47 and the pickup roller 4, and the limit value. The pickup arm 47 is configured to be able to be lifted by a solenoid (not shown) or the like. Furthermore, the one-way gear 41 and the gear train 55 are provided as a one-way transmission portion between the pickup roller 4 and the feed shaft 48.

The rotation of the input gear 52 is transmitted to the registration gear 43 via the electromagnetic clutch 37 as the second clutch. The registration gear 43 is fixed to one end of the registration shaft 7*b* on which the drive roller 7*a* of the registration roller pair 7 is supported. The description of the drive transmission mechanism for the other rollers included in the document conveying portion is omitted here.

With this configuration, when the electromagnetic clutches 36 and 37 are on, the rotation of the conveying motor 38 drives the pickup roller 4, the feed roller 5, and the registration roller pair 7 (drive roller 7*a*). In other words, the driving force of the conveying motor 38 can be transmitted to the pickup roller 4. By turning the electromagnetic clutch 36 on/off, the driving force of the conveying motor 38 can be transmitted to the feed roller 5 and the pickup roller 4 or cut off. Further, by turning the electromagnetic clutch 37 on/off, the driving force of the conveying motor 38 can be transmitted to the registration roller pair 7 (drive roller 7*a*) or cut off. With the one-way clutch 40 and the one-way gear 41, the driving force of the conveying motor 38 is transmitted to the feed roller 5 and the pickup roller 4, but the driving force of the feed roller 5 and the pickup roller 4 is not transmitted to the conveying motor 38.

(Control Block)

Figure 4:
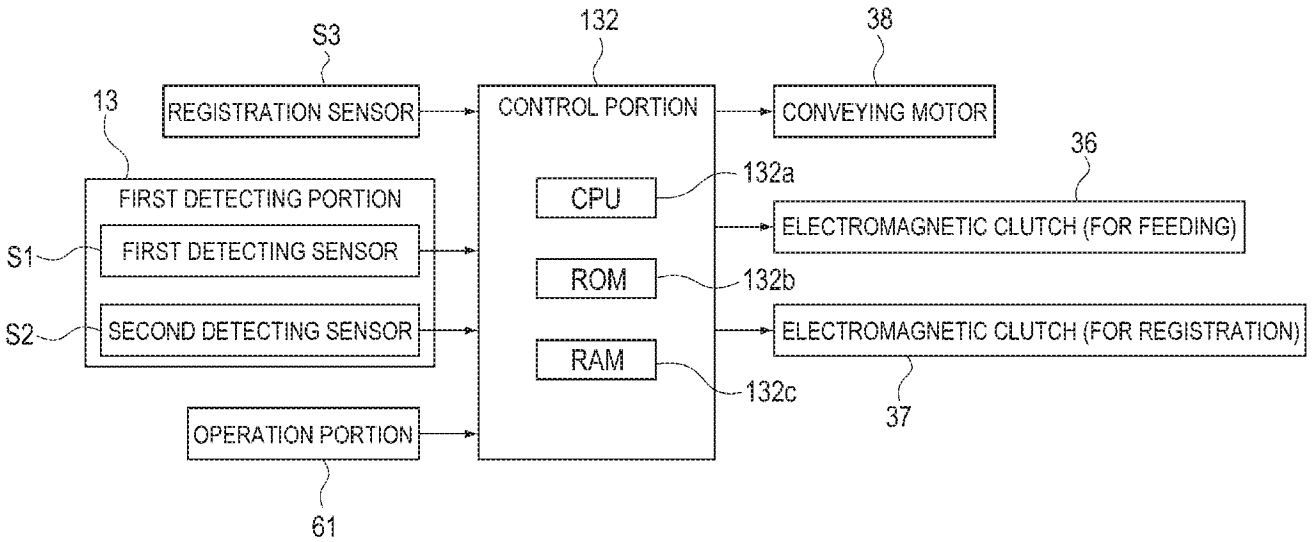
FIG. 4 is a control block diagram.

FIG. 4 shows a control block diagram for the present embodiment. The control portion 132 includes the CPU 132*a* as an arithmetic device, the ROM 132*b* in which various programs are stored, the RAM 132*c* used as an area for temporarily storing control data and as a working area for calculations. The operation portion 61 with a touch panel, operation keys, and the like is connected to the control portion 132. With the operation portion 61, various settings can be made and an image can be displayed on the touch panel. The first detecting sensor S1 and the second detecting sensor S2 of the first detecting portion 13, and the registration sensor S3 as the second detecting portion are connected to the input port of the control portion 132. The conveying motor 38, the electromagnetic clutches 36 and 37 are connected to the output port of the control portion 132. The control portion 132 controls the drive of the conveying motor 38 and the electromagnetic clutches 36 and 37 based on the detection signals of the sensors S1, S2, and S3, and further controls the feeding operation of the documents with the pickup roller, the feed roller, the registration roller pair, and the like.

(Feeding Control)

Figure 6:
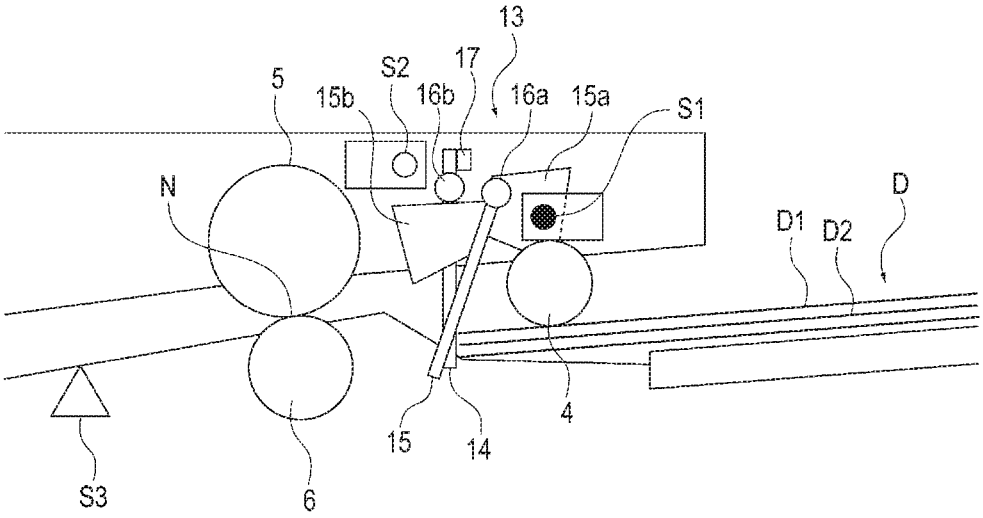
FIG. 6 illustrates the relationship between a flag and a detecting portion when a document is set.

Next, the feeding control will be described referring to the schematic diagrams of the document feeding in FIGS. 5, 6, 7, 8, and 9 and the flowchart of FIG. 10. As shown in FIG. 5, when the document D is not placed on the document feeding tray 2, the flag 15 is located at the first position (the position shown in FIG. 5). As the first and second light-shielding portions 15*a* and 15*b* are located at positions where the light of the light paths of the first and second detection sensors S1 and S2 are respectively transmitted, both the first detecting sensor S1 and the second detecting sensor S2 of the first detection section 13 are in a transmitting state (off state). The contact surface of the document stopper 14, which is a restricting member, and the contact surface of the flag 15 are arranged such that they extend vertically and in parallel to each other. At this time, as shown in FIG. 10, the control portion 132 determines whether or not the first detecting sensor S1 of the first detecting portion 13 is turned on (step S1). Then, as shown in FIG. 6, when the documents D (D1, D2) are placed on the document feeding tray 2, the entry of the leading ends of the documents D to the separation nip N is restricted by contacting the document stopper 14 so that the feeding start position is determined. At this time, the flag 15 is pushed by the leading ends of the documents D placed on the document feeding tray 2, is rotated in the conveying direction around the rotational fulcrum 16*a*, so that the light in light path of the first detecting sensor S1 is shielded (ON) by the first light-shielding portion 15*a* of the flag 15. As a result, the first detecting sensor S1 is turned on (step S1: YES) so that the fact that the document has been placed on the document feed tray 2 is detected. The control portion 132 then determines whether the size of the documents placed on the document feeding tray 2 has been selected (step S2).

In general, the image reading apparatus is configured to allow the user to select between an every-time designation mode and a fixed mode. In the every-time designation mode, when the first detecting sensor S1 of the first detecting portion 13 is turned on, an image is displayed on the operation portion 61, which image prompts a user to input the document information, such as the size and type of the documents placed on the document feeding tray 2. In the fixed mode, when the first detecting sensor S1 is turned on, the document information of the documents placed on the document feeding tray 2 is automatically set to pre-set values. In the flowchart shown in FIG. 10, the case of the every-time designation mode is taken as an example, but in the case of the fixed mode, step S2 may be omitted.

When the size of the documents is set from the operation portion 61 (step S2: YES), the control portion 132 drives the conveying motor 38 to rotate and turns on the electromagnetic clutches 36 and 37 (steps S3 and S4). As a result, the uppermost document D1 of the documents D placed on the document feeding tray 2 is fed by the pickup roller 4. When an image reading job is input between step S2 and step S3 for example, a solenoid (not shown) is activated so that the pickup arm 47 is lowered and the pickup roller 4 is in contact with the document. In conjunction with the lowering of the pickup arm 47, the restriction of the document stopper 14 is released by the releasing portion 17. That is, when the pickup roller 4 is located at an upward retreat position (the position indicated by the dashed line in FIG. 2) at which the pickup roller 4 is away from the document D placed on the document feeding tray 2, the rotation of the document stopper 14 in the document conveying direction is restricted. On the other hand, when the pickup roller 4 is located at the feeding position (the position indicated by the solid line in FIG. 2) at which the pickup roller 4 abuts against the document D placed on the document feeding tray 2, the releasing portion 17 moves downward, and the restriction of the rotation of the document stopper 14 in the document conveying direction around the rotational fulcrum 16*b* of the document stopper 14 is released.

Figure 7:
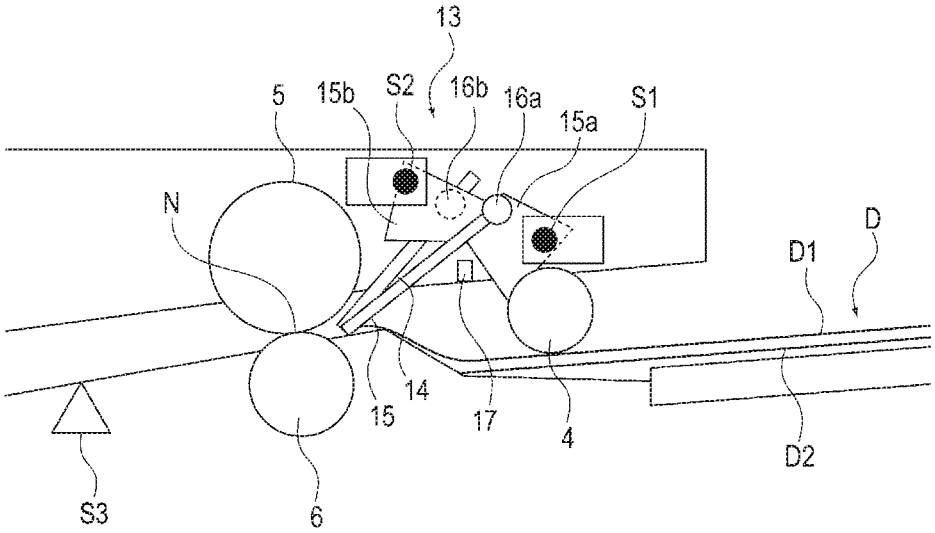
FIG. 7 illustrates the relationship between a flag and a detecting portion when feeding is started.

As shown in FIG. 7, when the document D1 is fed by the pickup roller 4, the document stopper 14 is pushed up by the leading end of the document D1 and the document D1 is conveyed to the document conveying path. The flag 15 is further pressed by the fed document D1, and the flag 15 is further rotated in the conveying direction around the rotational fulcrum 16*a*, so that the light in the light path of the second detecting sensor S2 of the first detecting portion 13 is shielded by the second shielding portion 15*b*. As a result, the second detecting sensor S2 is turned on (step S5: YES), thereby to detect that the feeding of the document D1 from the document feeding tray 2 has started. The document stopper 14 is also rotated in the conveying direction similarly to the flag 15.

The fed document D1 is conveyed by the feed roller 5, retard roller 6, and registration roller pair 7. The registration sensor (second detecting portion) S3 is turned on when the leading end of the document D1 passes through the registration sensor S3 as the second detecting portion in the document conveying path between the separation nip N formed by the feed roller 5 and retard roller 6, and the registration roller pair 7. When the predetermined time period T has passed after the registration sensor S3 is turned on, the control portion 132 turns off the electromagnetic clutch 36 (steps S6 and S7). As a result, the drive of the feed roller 5 and the pickup roller 4 is stopped. However, the electromagnetic clutch 37 is kept on so that the driven registration roller pair 7 continues to convey the document D1. In this embodiment, the skew feeding of the manuscript D1 is not corrected by the registration roller pair 7 between the step S6 and step S7. However, the skew feeding of the document D1 may be corrected by turning off the electromagnetic clutch 37 at the start of feeding, and by feeding the document D with the registration roller pair 7 stopped such that the leading end of the document D abuts against the registration roller pair 7.

Figure 8:
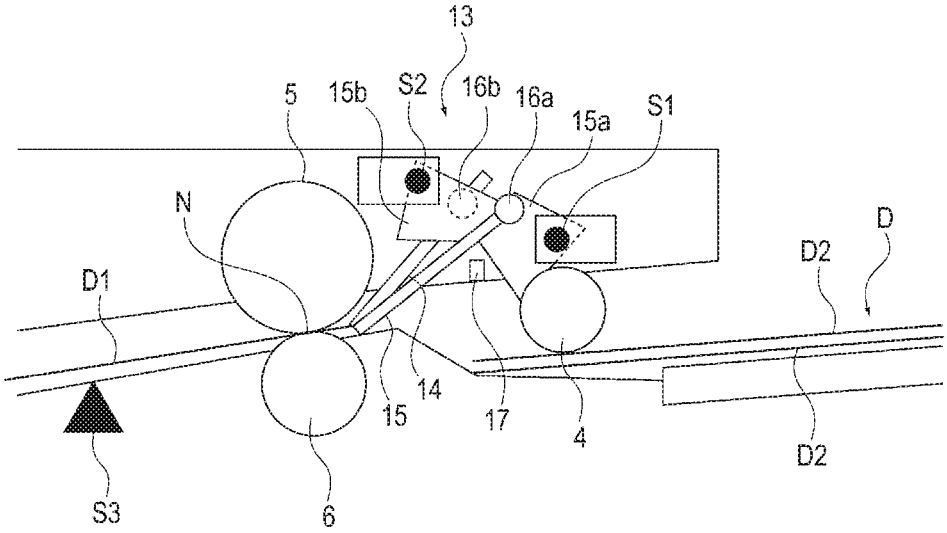
FIG. 8 illustrates the relationship between a flag, a detecting portion, and a position of the trailing end of a preceding document.

When the document D1 is further conveyed and the trailing end (the upstream end of the conveying direction) of the document D1 moves away from the tip of the flag 15 as shown in FIG. 8, the flag 15 rotates in the direction opposite to the conveying direction around the rotational fulcrum 16*a*. Namely, when the trailing end of the document D1 moves away from the tip of the flag 15, the flag 15 rotates from a position at which the light in the light path of the second detecting sensor S2 is shielded to a position at which the light in the light path of the second detecting sensor S2 is transmitted. As a result, the shielding of the light in the light path of the second detecting sensor S by the second light-shielding portion 15*b* of the flag 15 is released so that the second detecting sensor S2 is turned off (step S8: YES). Then, when the first detecting sensor S1 is ON, the next document D2 is conveyed (step S10: NO) and the control portion 132 turns the electromagnetic clutch 36 on again (step S4). Then, the feed roller 5 and the pickup roller 4 are driven again to start feeding the next document D2.

The feeding the next document D2 then may start before the trailing end of the previous document D1 is detected by the registration sensor S3, which is the second detecting portion. The first detecting portion 13 can detect a single flag at different times by two sensors. In detail, as described above, the trailing end of the previous document D1 (preceding sheet) can be detected by the second detecting sensor S2 when the shielding of the light in the light path of the second detection sensor S2 is released, and the presence or absence of the next document D2 (subsequent sheet) placed on the document feeding tray can be detected in accordance with on/off state of the first detecting sensor S1. Specifically, when the trailing end of the previous document D1 (preceding sheet) is detected by the second detecting sensor S2, and the first detecting sensor S1 is in on-state (the first light shielding portion 15*a* shields the light in the light path of the first detecting sensor S1), the control portion 132 starts feeding the next document D2 with the pickup roller 4 and feed roller 5. As such, it is possible to detect the presence or absence of a document to be set and the position of the trailing end of the conveyed document. This reduces the increase in cost due to the increase in flag components. In other words, according to the present embodiment, the presence or absence of a document to be set and the position of the leading or trailing end of a sheet to be conveyed with the number of parts reduced by one flag component as compared with a conventional apparatus, which leads to a reduction of the number of parts and a reduction of the cost.

Figure 9:
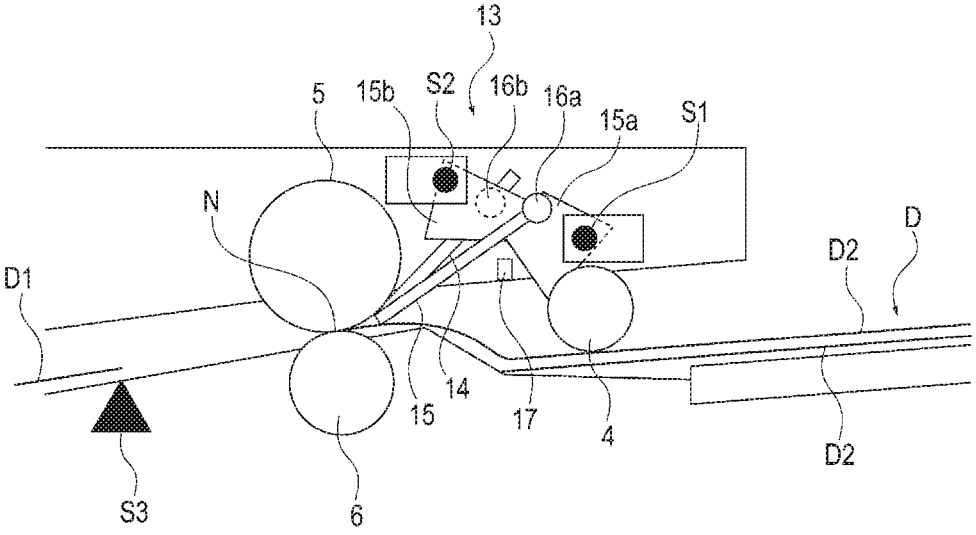
FIG. 9 illustrates the relationship between flag, detecting portion and position of trailing end of a preceding document.
Figure 10:
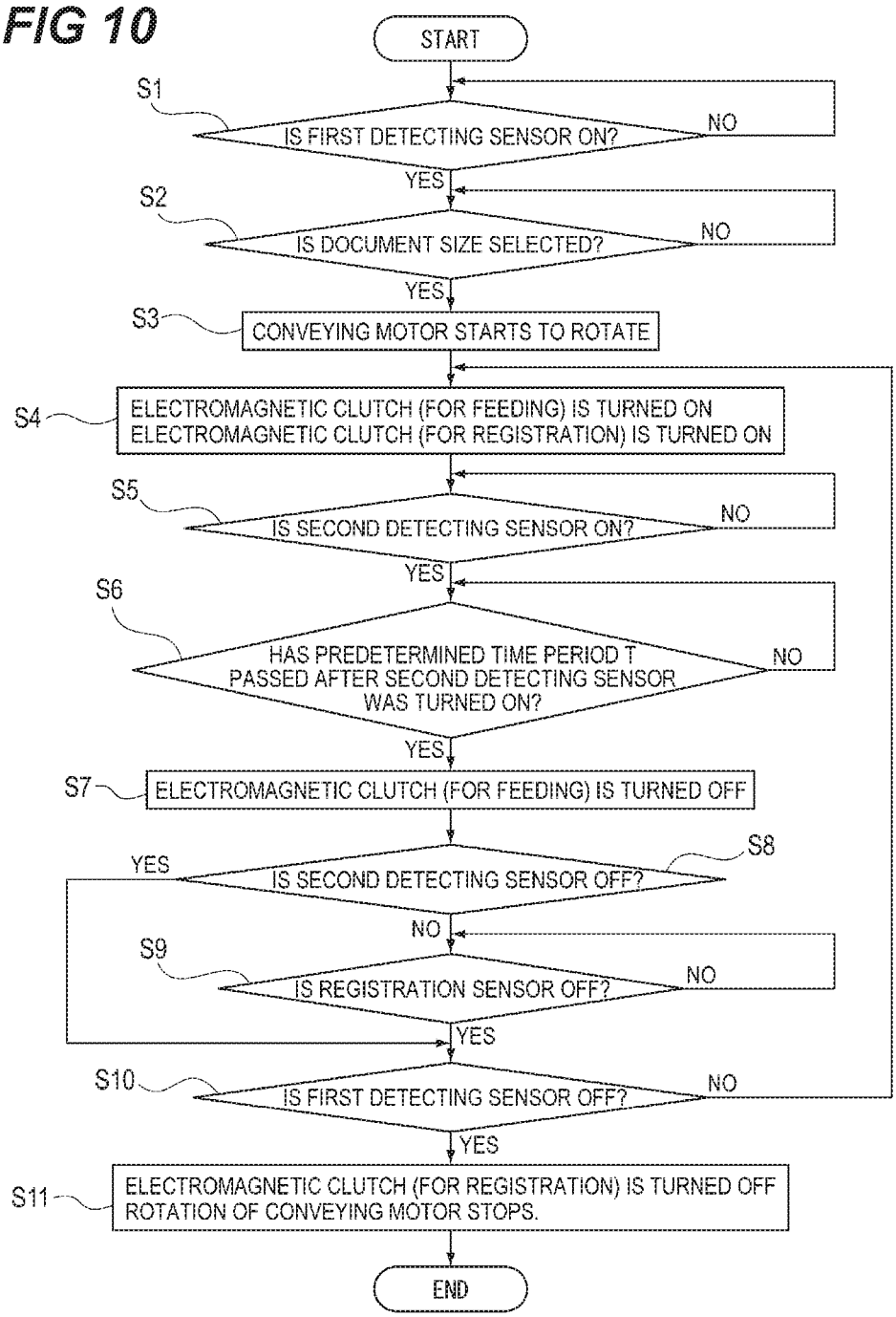
FIG. 10 is a flowchart indicating feeding control.

As shown in FIG. 9, when the leading end of the next document D2 has been fed to the feed roller 5 and the retard roller 6, the second detecting sensor S2 of the first detecting portion 13 is not turned off even if the trailing end of the previous document D1 passes the tip of the flag 15 (step S8: NO). In this case, when the trailing end of the previous document D1 passes through the registration sensor S3 (second detecting portion) and the registration sensor S3 is turned off (step S9: YES), the status of the first detecting sensor S1 is checked. When the first detecting sensor S1 is in on-state, it is determined that there is a document on the tray, and the control portion 132 turns on the electromagnetic clutch 36 again (step S4). As a result, the feed roller 5 and the pickup roller 4 are driven again to start feeding the next document D2.

When the first detecting sensor S1 of the first detecting portion 13 is in off-state (step S10: YES), the control portion 132 determines that there is no document on the tray, turns off the electromagnetic clutch 37, and stops the rotation of the conveying motor (step S11). That is, when the trailing end of the previous document D1 (preceding sheet) is detected by the second detecting sensor S2 and the first detection sensor S1 is turned off (the first light-shielding portion 15*a* releases the shielding of the light in the light path of the first detecting sensor S1), the control portion 132 starts feeding the next document D2 by the pickup roller 4 and the feed roller 5.

Thus, according to the present embodiment, the first detecting portion 13 detects one flag at different times by two sensors, thereby reducing the number of flag parts by one, which reduces the number of parts while suppressing the increase in cost.

Figure 11:
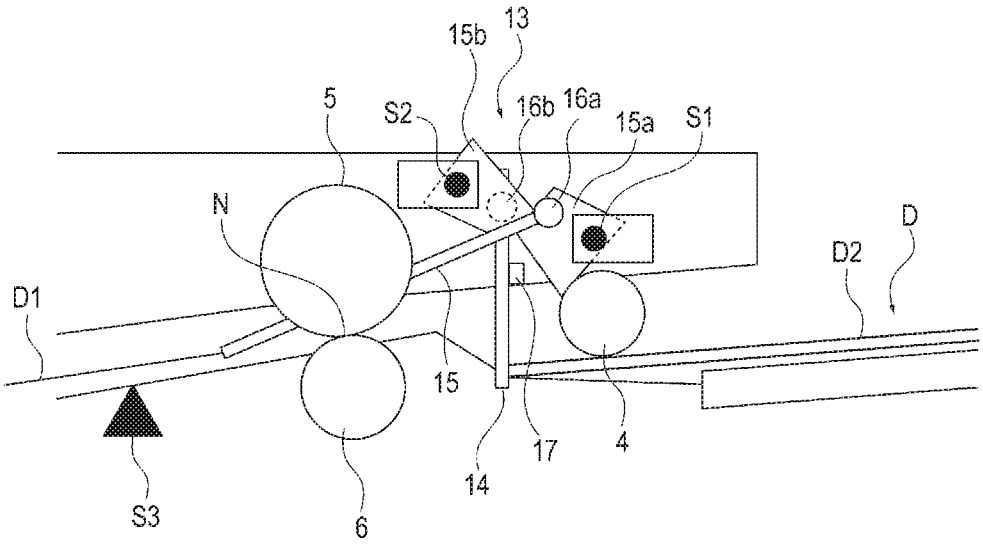
FIG. 11 illustrates the relationship between a flag, a detecting portion, and a position of the trailing end of a preceding document.

In the above-mentioned embodiment, the tip of the flag 15 to be rotated around the rotational fulcrum 16*a* does not exceed in the document conveying direction the separation nip N of the feed roller 5 and retard roller 6, and the position of the trailing end of the document to be detected in accordance with on/off state of the second detecting sensor S2 of the first detecting portion 13 is at the upstream side of the separation nip N. However, the present disclosure is not limited to this configuration. As shown in FIG. 11, it is possible that the tip of the flag 15 to be rotated around the rotational fulcrum 16*a* is in the range which exceeds in the document conveying direction the separation nip N of the feed roller 5 and retard roller 6. With this configuration, the position of the trailing end of the document can be detected after the separating portion in accordance with on/off state of the second detecting sensor S2.

In the above embodiment, a sheet conveying apparatus that conveys a sheet to be read, such as a document, is illustrated, but the present disclosure is not limited thereto. For example, the same effect can be obtained even when the present disclosure is applied to a sheet conveying apparatus that conveys a recording target sheet such as recording paper.

Further, in the above embodiment, the copying machine is exemplified as the image forming apparatus, but the present disclosure is not limited to this. For example, the apparatus to which the present disclosure applies may be another image forming apparatus such as a printer, a facsimile machine, and a multi-functional printer that combines these functions, or an image reading apparatus such as a scanner. The same effect can be obtained by applying the present disclosure to a sheet conveying apparatus used in the image forming apparatus or the image reading apparatus.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-Ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-192432, filed Oct. 23, 2019, which is hereby incorporated by reference herein in its entirety.

What is claimed is:

1. A sheet feeding apparatus comprising:

a tray on which a sheet is to be placed;

a feeding roller configured to feed the sheet at a feeding position at which the feeding roller abuts against the sheet placed on the tray;

a separating portion configured to form a separation nip configured to separate, one by one, sheets fed by the feeding roller;

a rotating member configured to be abutted by a leading edge of the sheet on the tray between the feeding position and the separation nip and to be rotated by pushing of the leading edge of the sheet;

a first detecting portion configured to detect presence or absence of a sheet on the tray by detecting rotation of the rotating member;

a second detecting portion configured to detect a trailing end of the sheet by detecting rotation of the rotating member in a case where the sheet passes between the feeding position and the separation nip in a sheet conveying direction;

a third detecting portion configured to detect the trailing end of the sheet at a position at downstream of the separation nip with respect to the sheet conveying direction; and a control portion configured to start feeding of a subsequent sheet on the tray by the feeding roller in a case where the third detecting portion detects a trailing edge of a preceding sheet, wherein the control portion is configured to start feeding of the subsequent sheet on the tray by the feeding roller according to detection of the trailing edge of the preceding sheet by the second detecting portion before detection of the trailing edge of the preceding sheet by the third detecting portion.

2. The sheet feeding apparatus according to claim 1, further comprising:

a restricting portion provided between the feeding position and the separation nip in the sheet conveying direction, wherein the restricting portion is configured to restrict a leading end position of the sheet placed on the tray by abutting a leading end of the sheet; and a releasing portion configured to release the restriction by the restricting portion of the leading end position of the sheet.

3. The sheet feeding apparatus according to claim 2, wherein the rotating member includes:

a first light-shielding portion configured to shield light in a light path of the first detecting portion, and a second light-shielding portion configured to shield light in a light path of the second detecting portion at a timing different from that of the first light-shielding portion, wherein the rotating member is configured to rotate from a first position to a second position by being pushed by the leading end of the sheet placed on the tray such that the leading end of the sheet is restricted by abutting against the restricting portion, so that the first light-shielding portion shields light in the light path of the first detecting portion, and wherein, after the restriction of the leading end position of the sheet is released by the releasing portion, the rotating member is configured to be rotated from the second position to a third position by being pushed by the leading end of the sheet fed from the tray by the feeding roller, so that the second light-shielding portion shields light in the light path of the second detecting portion.

4. The sheet feeding apparatus according to claim 1, wherein, when the control portion detects the trailing end of the separated preceding sheet using the second detecting portion and the control portion does not detect presence of a subsequent sheet placed on the tray using the first detecting portion, the control portion controls the feeding roller such that the feeding roller does not start to rotate.

5. An image reading apparatus comprising:

a sheet feeding apparatus; and an image reading portion configured to read an image of a sheet, wherein the sheet feeding apparatus includes:

a tray on which the sheet is to be placed, a feeding roller configured to feed the sheet at a feeding position at which the feeding roller abuts against the sheet placed on the tray, a separating portion configured to form a separation nip configured to separate, one by one, sheets fed by the feeding roller, a rotating member configured to be abutted by a leading edge of the sheet on the tray between the feeding position and the separation nip and to be rotated by pushing of the leading edge of the sheet, a first detecting portion configured to detect presence or absence of a sheet on the tray by detecting rotation of the rotating member, a second detecting portion configured to detect a trailing end of the sheet by detecting rotation of the rotating member in a case where the sheet passes between the feeding position and the separation nip in a sheet conveying direction, a third detecting portion configured to detect the trailing end of the sheet at a position at downstream of the separation nip with respect to the sheet conveying direction, and a control portion configured to start feeding of a subsequent sheet on the tray by the feeding roller in a case where the third detecting portion detects a trailing edge of a preceding sheet, wherein the control portion is configured to start feeding of the subsequent sheet on the tray by the feeding roller according to detection of the trailing edge of the preceding sheet by the second detecting portion before detection of the trailing edge of the preceding sheet by the third detecting portion.

6. The image reading apparatus according to claim 5, where the sheet feeding apparatus further comprises:

a restricting portion provided between the feeding position and the separation nip in the sheet conveying direction, wherein the restricting portion is configured to restrict a leading end position of the sheet placed on the tray by abutting a leading end of the sheet; and a releasing portion configured to release the restriction by the restricting portion of the leading end position of the sheet.

7. The image reading apparatus according to claim 6, wherein the rotating member includes:

a first light-shielding portion configured to shield light in a light path of the first detecting portion, and a second light-shielding portion configured to shield light in a light path of the second detecting portion at a timing different from that of the first light-shielding portion, wherein the rotating member is configured to rotate from a first position to a second position by being pushed by the leading end of the sheet placed on the tray such that the leading end of the sheet is restricted by abutting against the restricting portion, so that the first light-shielding portion shields light in the light path of the first detecting portion, and wherein, after the restriction of the leading end position of the sheet is released by the releasing portion, the rotating member is configured to be rotated from the second position to a third position by being pushed by the leading end of the sheet fed from the tray by the feeding roller, so that the second light-shielding portion shields light in the light path of the second detecting portion.

8. The image reading apparatus according to claim 5, wherein, when the control portion detects the trailing end of the separated preceding sheet using the second detecting portion and the control portion does not detect presence of a subsequent sheet placed on the tray using the first detecting portion, the control portion controls the feeding roller such that the feeding roller does not start to rotate.

9. An image forming apparatus, comprising:

a sheet feeding apparatus; and an image forming portion configured to form an image on a sheet, wherein the sheet feeding apparatus includes:

a tray on which the sheet is to be placed, a feeding roller configured to feed the sheet at a feeding position at which the feeding roller abuts against the sheet placed on the tray, a separating portion configured to form a separation nip configured to separate, one by one, sheets fed by the feeding roller, a rotating member configured to be abutted by a leading edge of the sheet on the tray between the feeding position and the separation nip and to be rotated by pushing of the leading edge of the sheet, a first detecting portion configured to detect presence or absence of a sheet on the tray by detecting rotation of the rotating member, a second detecting portion configured to detect a trailing end of the sheet by detecting rotation of the rotating member in a case where the sheet passes between the feeding position and the separation nip in a sheet conveying direction, a third detecting portion configured to detect the trailing end of the sheet at a position at downstream of the separation nip with respect to the sheet conveying direction, and a control portion configured to start feeding of a subsequent sheet on the tray by the feeding roller in a case where the third detecting portion detects a trailing edge of a preceding sheet, wherein the control portion is configured to start feeding of the subsequent sheet on the tray by the feeding roller according to detection of the trailing edge of the preceding sheet by the second detecting portion before detection of the trailing edge of the preceding sheet by the third detecting portion.

10. The image forming apparatus according to claim 9, where the sheet feeding apparatus further includes:

a restricting portion provided between the feeding position and the separation nip in the sheet conveying direction, wherein the restricting portion is configured to restrict a leading end position of the sheet placed on the tray by abutting a leading end of the sheet; and a releasing portion configured to release the restriction by the restricting portion of the leading end position of the sheet.

11. The image forming apparatus according to claim 10, wherein the rotating member includes:

a first light-shielding portion configured to shield light in a light path of the first detecting portion, and a second light-shielding portion configured to shield light in a light path of the second detecting portion at a timing different from that of the first light-shielding portion, wherein the rotating member is configured to rotate from a first position to a second position by being pushed by the leading end of the sheet placed on the tray such that the leading end of the sheet is restricted by abutting against the restricting portion, so that the first light-shielding portion shields light in the light path of the first detecting portion, and wherein, after the restriction of the leading end position of the sheet is released by the releasing portion, the rotating member is configured to be rotated from the second position to a third position by being pushed by the leading end of the sheet fed from the tray by the feeding roller, so that the second light-shielding portion shields light in the light path of the second detecting portion.

12. The image forming apparatus according to claim 9, wherein, when the control portion detects the trailing end of the separated preceding sheet using the second detecting portion and the control portion does not detect presence of a subsequent sheet placed on the tray using the first detecting portion, the control portion controls the feeding roller such that the feeding roller does not start to rotate.

* * * * *